United States Patent [19]

Swenson

[11] Patent Number: 5,014,014

[45] Date of Patent: May 7, 1991

[54] PLANE WAVE TRANSFORMER LINAC STRUCTURE

[75] Inventor: Donald A. Swenson, Albuquerque, N. Mex.

[73] Assignee: Science Applications International Corporation, San Diego, Calif.

[21] Appl. No.: 361,942

[22] Filed: Jun. 6, 1989

[51] Int. Cl.[5] ..... H01J 25/10; H01J 9/00; H05H 9/04

[52] U.S. Cl. ..... 328/233; 315/541; 445/23

[58] Field of Search ..... 315/5.41, 5.42; 328/233; 445/23, 29, 33, 44

[56] References Cited

U.S. PATENT DOCUMENTS

| | | | |
|---|---|---|---|
| 4,006,422 | 2/1977 | Schriber | 328/233 |
| 4,024,426 | 5/1977 | Vaguine | 315/5.41 |
| 4,112,373 | 10/1978 | Vaguine | 315/5.41 |
| 4,118,652 | 10/1978 | Vaguine | 315/5.41 |
| 4,146,817 | 3/1979 | McEuen et al. | 315/5.41 |
| 4,162,423 | 7/1979 | Tran | 315/5.41 |
| 4,181,894 | 1/1980 | Pottier | 328/233 |
| 4,211,954 | 7/1980 | Swenson | 315/5.41 |
| 4,350,921 | 9/1982 | Liska | 313/360.1 |
| 4,425,529 | 1/1984 | Leboutet | 315/5.41 |
| 4,485,346 | 11/1984 | Swenson et al. | 328/233 |
| 4,594,530 | 6/1986 | Aucouturier et al. | 315/5.41 |
| 4,595,946 | 6/1986 | Pottier | 315/5.41 |
| 4,629,938 | 12/1986 | Whitham | 315/5.41 |
| 4,639,641 | 1/1987 | Tronc | 315/5.41 |
| 4,651,057 | 3/1987 | Uetomi et al. | 315/5.41 |
| 4,712,042 | 12/1987 | Hamm | 315/5.41 |
| 4,715,038 | 12/1987 | Fraser et al. | 372/2 |

OTHER PUBLICATIONS

"High Energy Structures for High Gradient Proton Linac Applications", IEEE Transactions on Nuclear Science, vol. NS-24, No. 3, Jun. 1977, pp. 1087-1090.

"PIGMI: A Pion Generator for Medical Irradiations", Donald A. Swenson, LAL-81-6 Mini-Review, Feb. 1981, Los Alamos National Laboratory.

"Manifold-Coupled Linac Structure", Donald A. Swenson, Texas Accelerator Center, The Woodlands, TX, 5/85.

"Development of Disk-and-Washer Cavity in KEK", S. Inagaki, et al., IEEE Transactions on Nuclear Science, vol. NS-30, No. 4, Aug. 1983.

*Primary Examiner*—Kenneth Wieder

*Attorney, Agent, or Firm*—Fitch, Even, Tabin & Flannery

[57] ABSTRACT

A plane wave transformer linear accelerator structure for accelerating charged particles to velocities greater than one-half the speed of light. The accelerator includes a tank section having a generally cylindrical tank wall. End plates each containing a central aperture for accommodating the passage of a charged particle beam are positioned adjacent to the ends of the tank wall. Support rods extend between the end plates, partially defining at least one axially-extending outer cavity and at least one axially-extending inner cavity. A plurality of axially-spaced washers situated substantially on the central axis of the tank section are supported by the rods. The washers each have central apertures which together define a charged particle beam acceleration path through the tank section.

24 Claims, 7 Drawing Sheets

ELECTRON LINEAR ACCELERATOR SYSTEM

E FIELD DISTRIBUTION
IN PWT STRUCTURE

E FIELDS FOR PWT LINAC

E FIELDS FOR PRIOR ART
CCL LINAC

PLANE WAVE TRANSFORMER LINAC STRUCTURE

This invention relates generally to linear particle accelerators (linacs), and more specifically to standing-wave, coupled-cavity electron linacs.

BACKGROUND OF THE INVENTION

There are more commercial applications for electron linacs than for any other type of particle accelerator. To date, over 1000 linacs have been installed in hospitals throughout the United States. Although these hospitals use linacs primarily for medical therapy, the devices also find applications in industrial settings and in the scientific community. Electron linacs are useful in the areas of atomic research, electron beam therapy, X-ray therapy, diagnostics, sterilization, polymerization, synchrotron light sources, free electron lasers, and accelerating structures for microtrons.

Linac art may be categorized by wave properties, yielding standing wave linacs and traveling wave linacs. Alternatively, accelerators may be classified according to particle velocities. In general, low-beta accelerators operate at less than half the speed of light, whereas high-beta linacs operate at higher speeds.

Most contemporary standing wave, high-beta linacs utilize a side-coupled cavity configuration which was invented at Los Alamos Meson Physics Facility in the mid-60's. Although exemplary, this structure is not ideally suited for certain specific applications. For instance, side-coupled linacs are heavy, fragile, and expensive. The cavity configuration is inherently difficult to fabricate, requiring relatively complex, expensive, and labor-intensive manufacturing techniques. Furthermore, the structure is heavy, fragile, and very difficult to tune.

For further information concerning the operation and structure of prior art linacs, reference may be made to "High Energy Accelerating Structures for High Gradient Proton Linac Applications" by Manca et al., *IEEE Transactions on Nuclear Science*, Vol. NS-24, No. 3, June 1977, pp. 1087–1090 and "PIGMI: A Pion Generator for Medical Irradiations" by Swenson, Los Alamos National Laboratory, Pub. LAL-81-6, Feb. 1981.

SUMMARY OF THE INVENTION

Among the several aspects and features of the present invention may be noted provision for an improved standing wave, high-beta linear accelerator. The plane wave transformer linac structure of the present invention offers advantages over other known linac structures in the areas of power efficiency, field stability, weight, fabrication simplicity, and costs. When a plane wave transformer linac and a side-coupled linac are both fed with the same amount of input power, the plane wave transformer linac will provide higher output energies and higher beam currents. Alternatively, the plane wave transformer linac requires less input power than the side-coupled linac structure to achieve a fixed level of output energy or current. Relatively large temperature differentials may exist within the structure, thereby simplifying the cooling system. The structure is relatively lightweight, simple to fabricate, simple to evacuate, easy to tune, and easy to excite.

A plane wave transformer linac embodying various aspects of the present invention comprises a cylindrical tank section with an array of washers along the axis.

The accelerator geometry is designed to provide efficient TEM mode operation for propagating power along the outer part of the structure and for coupling the individual cells together. Power propagates back and forth between the end plates at the speed of light, setting up a standing wave pattern. Washers are positioned within the structure to transform the TEM field pattern into a bidirectional longitudinal electric field along the charged particle beam acceleration path. This bidirectional field can be characterized as a TM02-like mode. For adjacent cavities, these strong field components are always 180 degrees out of phase. The washers defining the cavities are spaced (beta$\times$lambda)/2 apart so that when the particles have moved into the next cell, the fields have reversed in that cell to represent an accelerating field. Therefore, the particles receive an accelerating impulse in each cell of the structure. The acceleration results from a standing wave pattern of electromagnetic fields having strong electric field components along the charged particle beam acceleration path. Since the structure transforms the TEM mode, sometimes referred to as a plane wave field configuration, into an accelerating field, the structure is appropriately named a "plane wave transformer".

An important advantage of the present structure relates to the interplay between the TEM and TM02 modes. Real currents are required to support either of these two modes independently. However, when both of these modes are utilized in a linac structure, some of the real currents are replaced by displacement currents. Real currents heat the cavity walls, resulting in ohmic losses and lower linac efficiency. On the other hand, displacement currents are not associated with ohmic losses, permitting the design of a higher efficiency linac.

The plane wave transformer of the present invention is reliable in use, has long service life and is relatively easy and economical to fabricate. Other aspects and features of the present invention will be in part apparent and in part pointed out specifically in the following specification and accompanying drawings.

BRIEF DESCRIPTION OF THE DRAWINGS

Corresponding reference characters indicate corresponding components throughout the several views of the drawings.

DESCRIPTION OF THE PREFERRED EMBODIMENTS

Figure 1:
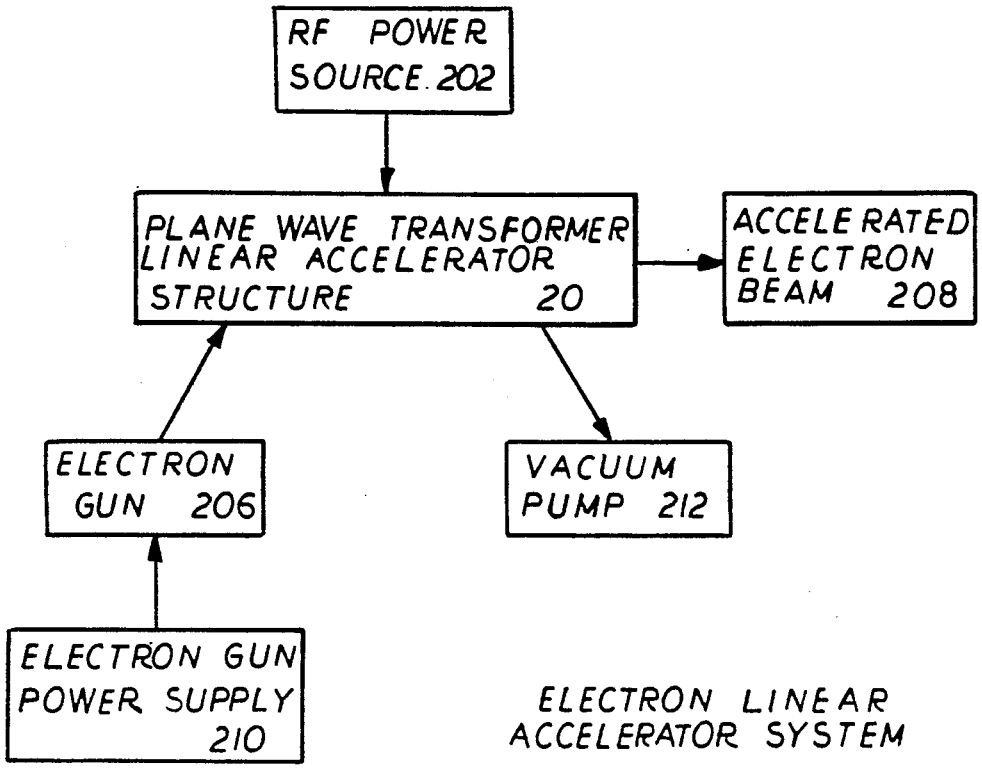
FIG. 1 is a general block diagram of an electron linear accelerator system.

Referring now to the drawings, a general block diagram of an electron linear accelerator system embodying various aspects of the present invention is shown in FIG. 1. An RF power source 202 feeds RF power into the plane wave transformer linear accelerator structure 20. An electron gun power supply 210 energizes the electron gun 206. Electron gun 206 produces the electrons which are accelerated by the plane wave transformer linear accelerator structure 20. The accelerator structure 20 emits an accelerated electron beam 208. A vacuum pump 212 evacuates the accelerator structure to render electron beam acceleration possible.

Figure 2:
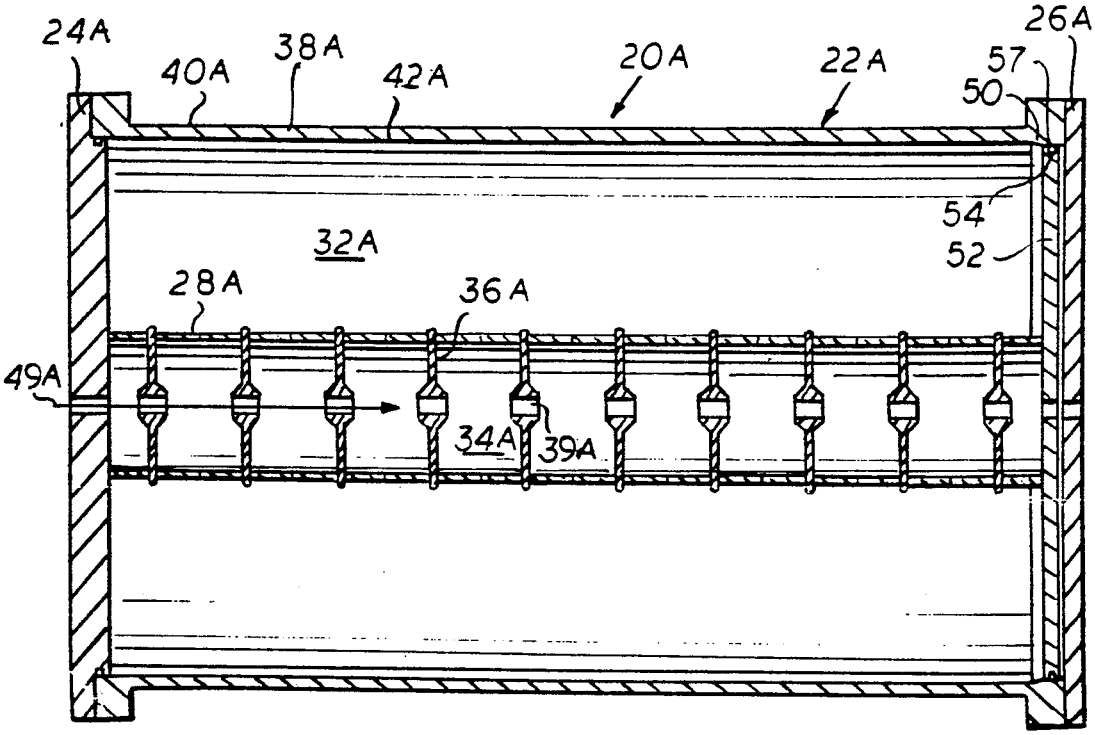
FIG. 2 is a cross-sectional view of a low-energy plane wave transformer linear accelerator structure embodying various features of the present invention.

A portion of a plane wave transformer linear accelerator embodying various aspects of the present invention for accelerating charged particles to velocities greater than about one-half the speed of light is generally indicated in FIG. 2 by reference character 20A. The accelerator includes a tank section 22A, end plates 24A, 26A, support rods 28A, and washers 36A.

As shown in FIG. 2, tank section 22A has a generally cylindrical outer wall 38A, with an outside surface 40A, and an inside surface 42A. The outer wall 38A is fabricated from thin-walled aluminum tubing of $\frac{1}{4}''$–$\frac{1}{2}''$ thickness to reduce the weight of the structure, while the inner surface 42A is copper-plated to increase its electrical conductivity.

The tank section 22A includes support means which in the preferred embodiment are three or more hollow cylindrical metallic support rod assemblies 28A. The support rods 28A are hollow to allow for the passage of liquid coolant. Tank section 22A further includes a series of axially spaced washers 36A disposed inside the tank wall 38A. Each of the washers 36A are held in place by support rods 28A. The washers 36A, preferably fabricated from oxygen-free, high-conductivity (OFHC) copper, lie in parallel planes, and each washer has a central aperture 39A. Together, these apertures 39A define a linear charged particle beam acceleration path 49A through the tank section 22A. Since coolant flowing through the support rods 28A provides sufficient cooling for the entire linac structure, the washers 36A may be fabricated from solid material, thus eliminating potentially troublesome water-vacuum joints.

Figure 6:
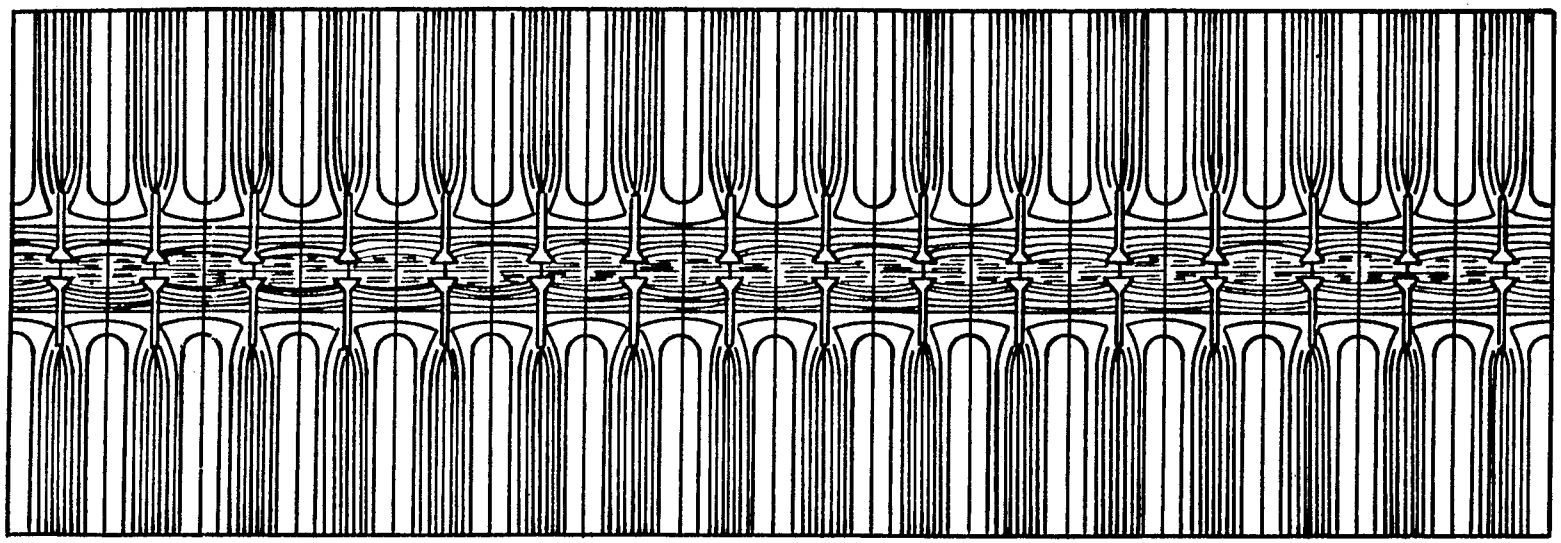
FIG. 6 illustrates the electric field distributions existing within the plane wave transformer linear accelerator structures of FIGS. 2, 3, 4 and 5.

As shown in FIG. 2, the geometry of the plane wave transformer linac provides for transverse electromagnetic field mode (TEM-Mode) operation in the outer cavity 32A between the tank wall 22A and the outer rims of the washers 36A. Thus, the TEM Mode is used to propagate power along the length of the structure, and to provide coupling between the individual cells 34A. RF energy travels back and forth between the end plates 24A, 52 at the speed of light, setting up the standing wave pattern depicted in FIG. 6. The standing waves drive a TM02-like mode in the individual cells 34A. These cells 34A are defined by the spaces between the washers 36A.

The center-to-center spacing of the washers 36A and the radii of the washers 36A are both related to the desired operating frequency f of the linac structure. The operating frequency f defines a specific wavelength lambda by the relationship lambda equals the speed of light divided by frequency. Washer spacing should be approximately one-half lambda along the central axis of the linac, and washer radii should be approximately 0.41 times lambda.

RF power losses within the accelerator structure are related to the radius of the outer cavity 32A and the length of the outer cavity 32A along the charged particle beam acceleration path 49A of the linac. Even though the outer cavity 32A radius has a major effect on the overall efficiency of the accelerator, it has no effect on the resonant frequency of the TEM mode. RF losses at the end plates 24A, 52 increase with increasing outer cavity 32A radii. However, as the outer cavity radii are increased, the RF losses associated with the outer wall 38A decrease. The optimum outer cavity 32A radius is equal to one-quarter the length of the outer cavity 32A.

The mechanical dimensions of a plane wave transformer linac, such as the washer radii, the washer spacing, the radius of the outer cavity, and the length of the outer cavity along the central axis of the linac, need not be determined empirically. Many of these physical dimensions may be optimized analytically through the use of a computer program known as "SUPERFISH". The SUPERFISH program is used extensively around the world to calculate the resonant frequencies and electromagnetic field properties of axisymmetric cavity modes in axisymmetric resonant cavities of otherwise arbitrary shape. SUPERFISH is available at Science Applications International Corporation and at many large universities and research institutions throughout the world.

SUPERFISH operates in the r-z plane of the cylindrical coordinate system. The cavity geometry is completely defined by the intersection of the cavity walls with the r-z plane. The electric field lines lie within the r-z plane, and the magnetic field lines are normal to the r-z plane. The program is restricted to geometries and electromagnetic field configurations that are azimuthally symmetric (independent of phi).

The outline of the cavity in the r-z plane is covered by an irregular triangular mesh. The RF fields are described by the azimuthal magnetic field strength at the mesh points. Maxwell's equations reduce to one difference equation for the magnetic field at every mesh point on and inside the problem boundary. One mesh point is used as the RF drive point, and its field value is set to unity. The resulting set of inhomogenous linear equations is solved by non-iterative, Gaussian block elimination and back substitution processes. The coefficients of the difference equations are frequency-dependent, and the solution yields a term that reveals the proximity of a given frequency to the nearest resonant frequency of the cavity. Starting from an initial estimate of the frequency of the desired mode, the program proceeds, by means of limiting techniques, to find the nearest resonant frequency and the associated fields in the cavity. For more information concerning this computer program, refer to K. Halbach and R. F. Holsinger, "*SUPERFISH—A Computer Program for Evaluation of RF Cavities With Cylindrical Symmetry*", *Particle Accelerators*, 1976, Vol. 7, pp. 213–222.

The SUPERFISH program can also evaluate, display, or list many other properties of the resonant cavities, such as power dissipation, stored energy, Q, shunt impedance, and transit time factors. The user can determine how the resonant frequency varies with cavity dimensions. The various electromagnetic field modes for simple cavity geometries can be examined.

Appendix 1 is a chart which sets forth cavity parameters for a plane wave transformer linac, such as the linac illustrated in FIG. 2, designed to operate at approximately 3 GHz with relatively moderate accelerating energies. These parameters were calculated analytically with the aid of the SUPERFISH program. Of particular relevance is the shunt impedance of the structure, which is 265.70 megohms per meter. Such a high value of shunt impedance, corresponding to a Q value of 98867, provides an efficient linac with very low power losses.

The linac shown in FIG. 2 is easy to fabricate because most of the construction may take place outside the confines of the tank walls. The linac of FIG. 2 includes an internal end plate 52 with a slot 57 for receiving the captively-held compression spring 54. The tank wall 38A includes a self-centering ramp 50. These additional features allow for the fabrication of critical subassemblies outside the confines of tank wall 38A.

A typical assembly sequence for the linac illustrated in FIG. 2 proceeds as follows. First, the washers 38A are assembled on the cylindrical support rods 28A. Next, these washers 36A are held in place by brazing, electron-beam or heliarc welds. Then, one end, e.g., for purposes of illustration the right-hand end, of the washer-support rod assembly is attached to a structure end plate 52. Meanwhile, an end plate 26A is fixed to the right end of the tank wall. Note that this end of the tank wall contains a self-centering ramp 50. The left-hand end of the washer-support rod structure end plate assembly is now fixed to end plate 24A. The right-hand end of the resulting washer-rod-plate assembly is inserted into the left-hand side of the tank wall-end plate assembly. The assemblies are moved relative to one another such that the captively-held compression spring 54 on the structural end plate 52 is compressed by the self-centering ramp 50 of the outer tank wall 38A making electrical contact with the inner surface of the ramped wall section 38A.

The linear accelerator illustrated in FIG. 2 can be termed a "short" linac because the axial dimension of the tank section 22A is relatively short, on the order of one meter in length. These short linacs develop approximately 10 to 15 MEV, which is an ideal energy level for many medical applications.

Figure 3:
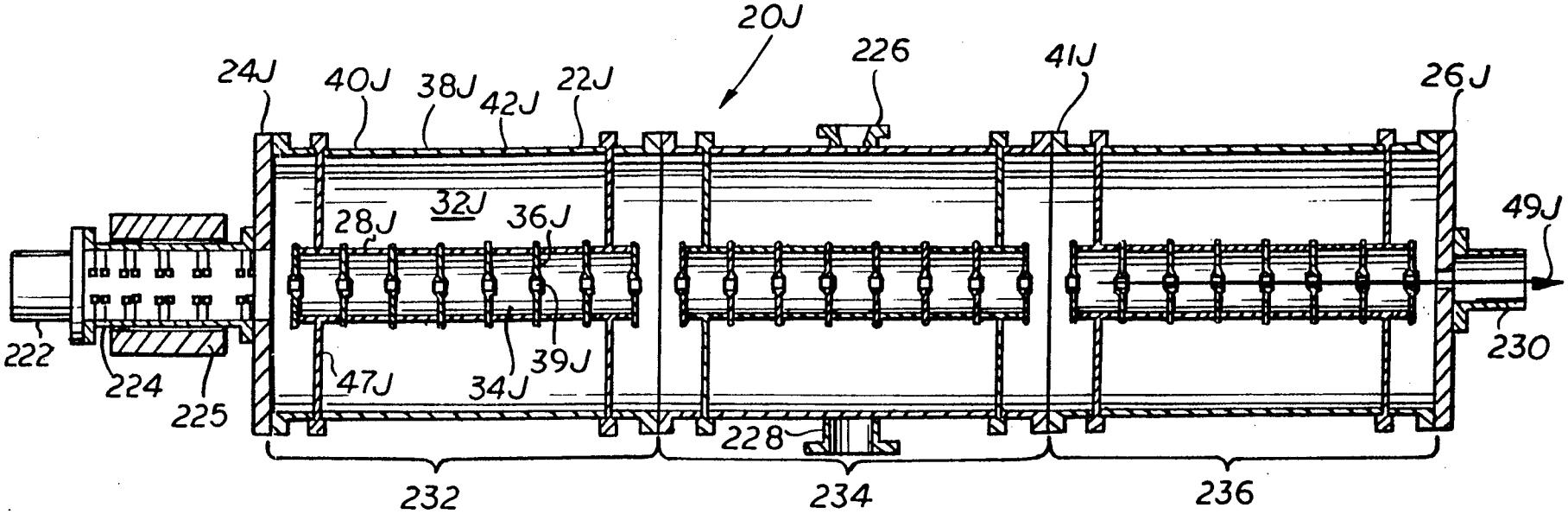
FIG. 3 is a cross-sectional view of an intermediate-energy plane wave linear accelerator embodying various features of the present invention which includes washers, support rods, end plates, and a tank wall.

FIG. 3 illustrates an alternative embodiment of the plane wave transformer linac shown in FIG. 2. Individual tank sections 232, 234, and 236 may be interconnected to form the structure illustrated in FIG. 3. This portable linac structure 20J may be used to develop intermediate energy levels of approximately 15 to 240 MeV.

Referring now to FIG. 3, each individual tank section 232, 234, and 236 is comprised of a generally cylindrical outer wall 38J, with an inside surface 40J and an outside surface 42J. As with a short linac structure, the outer wall 38J of the long linac may be fabricated from thin wall aluminum tubing (½" thickness); the inner surface 40J is copper plated.

Although the linac shown in FIG. 3 appears very similar to the short linac depicted in FIG. 2, the linac section of FIG. 3 contains some additional components. Each end of the tank wall 38J contains mounting means 41J such that individual tank sections 232, 234, and 236 may be joined together. Radial posts 47J rre situated at E-field minima so that RF energy will flow into the adjacent tank sections. As shown in FIG. 3, these radial posts 47J are supported by the tank wall 38J.

The radial posts 47J hold the support rods 28J, and the support rods 28J support the washers 36J. The washers 36J each contain a central aperture 39J to allow for the passage of a charged particle beam. The support rods 28J are hollow to allow for the passage of liquid coolant.

An electron gun 222 provides a source of charged particles for the linear accelerator 20J. Buncher section 224 and solenoid 225 shape and focus the charged particle beam along a linear charged particle beam acceleration path 49J. RF power is fed into the linear accelerator 20J through an RF power port 226. The linear accelerator 20J is evacuated through vacuum port 228. A charged particle beam output port 230 is provided.

Figure 9A:
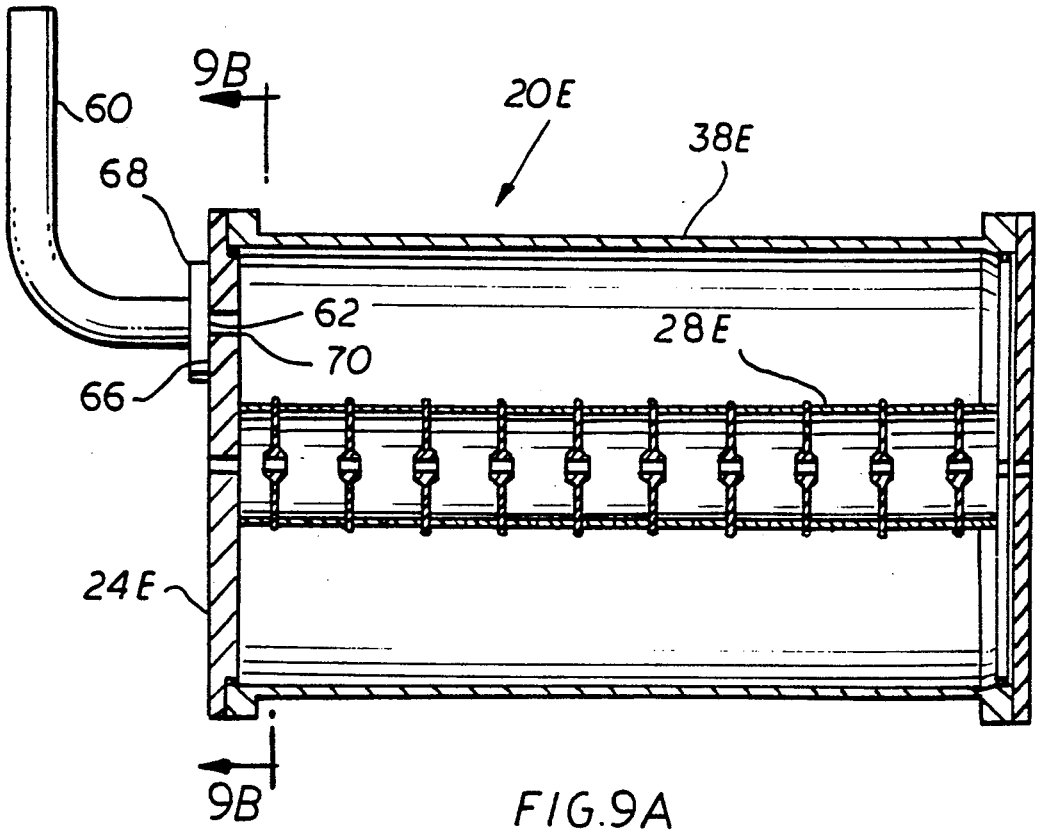
FIGS. 9A, 9B, 9C, and 9D illustrate methods of coupling RF power into the plane wave transformer linear accelerator structure.

RF power may be coupled into a plane wave transformer linac 20E using the method depicted in FIG. 9A. The RF power is generated by a high-powered microwave transmitter and coupled into the first end of the RF power waveguide 60. The second end of the waveguide 60, which includes a flange 68, is connected to the plane wave transformer linac 20E. The flange 68 contains a slot 62 flanked by a plurality of small holes 66. The slot 62 carries the RF power into the linear accelerator 20E, and the holes 66 are used to accommodate screws which will mount the flange 68 to the linear accelerator 20E.

RF power is introduced through a slot 70 in the end plate 24E. The long dimension of the slot 70 is perpendicular to the radius of the end plate 24E. The center of the slot 70 is positioned at a point approximately midway between the tank wall 38E and the washer support rods 28E to allow for maximum power transfer. The end plate 24E contains a plurality of small holes 74 which line up with the holes 66 in the waveguide flange 68.

Figure 9C:
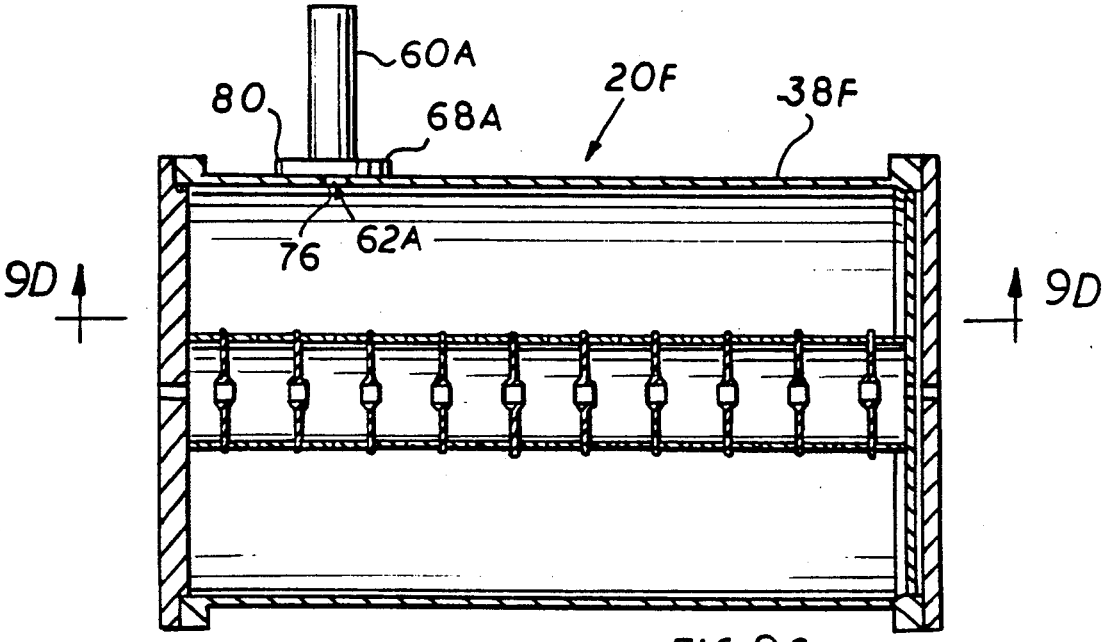
Figure 9B:
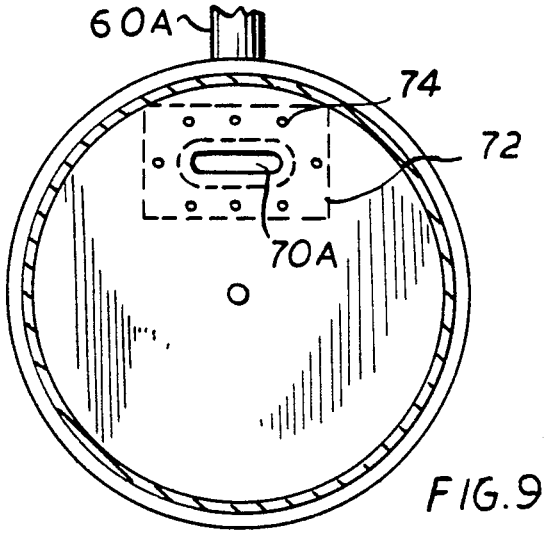
Figure 9D:
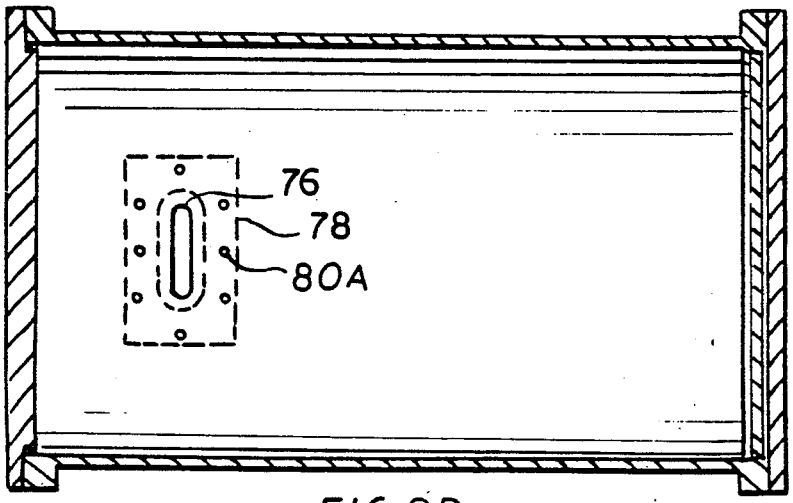

FIG. 9C illustrates a second method for coupling RF power into the linear accelerator. RF power is introduced through a slot 76 in the tank wall 38F. The long dimension of the slot 76 is parallel to the plane of the end plate 24F. The slot 76 is flanked by a flange 78 which mates with the waveguide flange 68A. The waveguide flange 68A contains a plurality of small holes 80, which line up with small holes 80A on the tank wall flange 78.

Although the linac structures depicted in FIGS. 2 and 3 have numerous clinical applications, it is often desirable to operate at higher energy levels. Linear accelerators which can develop energy levels on the order of hundreds of MeVs are useful as injectors for synchrotron or electron storage rings. These rings are utilized for semiconductor research and fabrication, as well as for other commercial processes.

Figure 4:
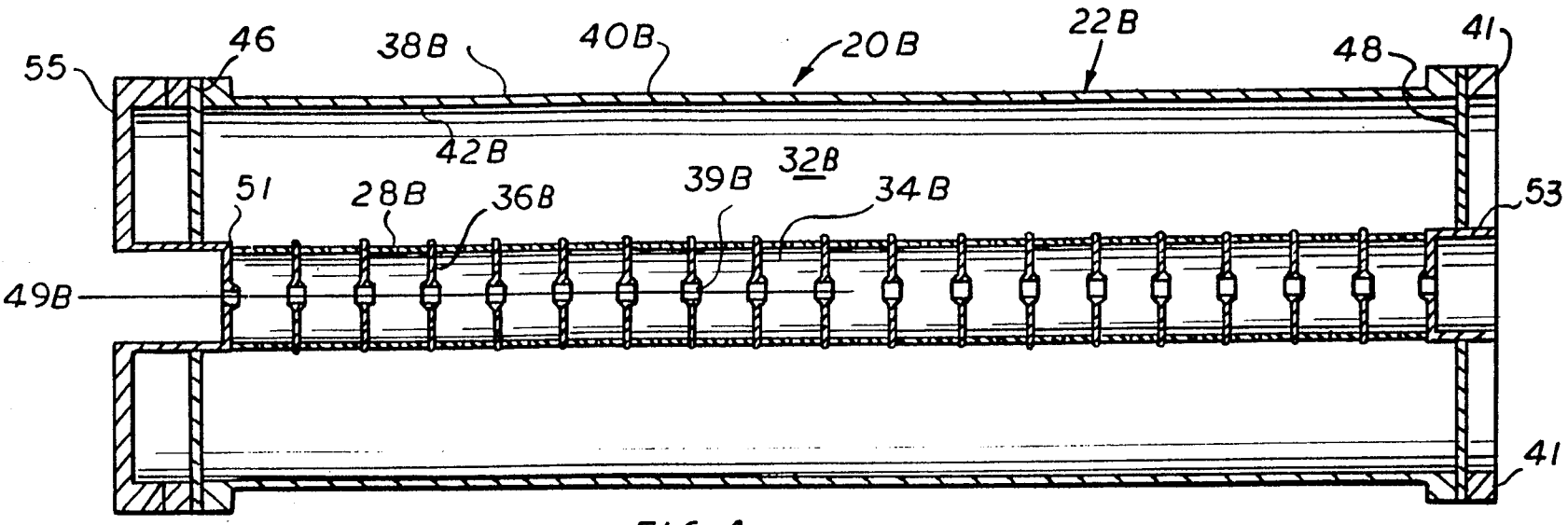
FIG. 4 is a cross-sectional view of one individual tank section from a high-energy plane wave linear accelerator embodying various features of the present invention which, includes washers, support rods, end plates, terminating caps, and a tank wall.
Figure 5:
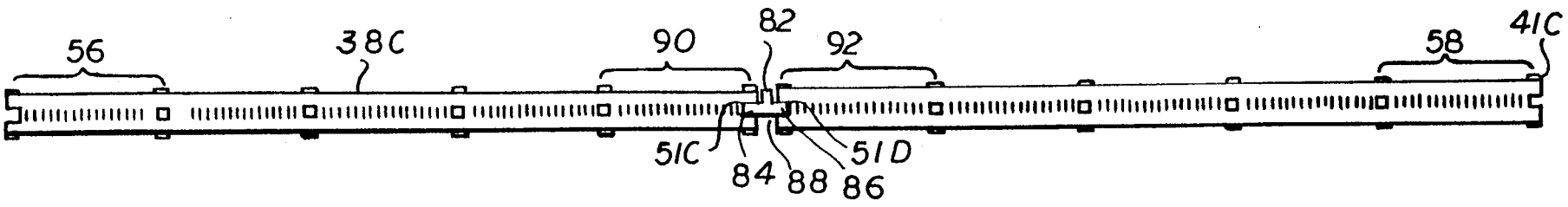
FIG. 5 is a reduced view of an entire high-energy plane wave linear accelerator structure comprised of ten individual tank sections, each similar to the section depicted in FIG. 4.

The linac illustrated in FIGS. 4 and 5 may be used to develop energies in excess of 100 MeV. As the resulting structure has a much longer axial dimension than the linacs of FIGS. 2 and 3, this linac can be termed a "long" linac. FIG. 4 depicts one individual tank section of a long linac. These individual tank sections may be interconnected to form the structure illustrated in FIG. 5.

Referring now to FIG. 4, each individual tank section 22B is comprised of a generally cylindrical outer wall 38B, with an outside surface 40B and an inside surface 42B. As with a short linac structure, the outer wall 38B of the long linac may be fabricated from thin wall aluminum tubing (¼" to ½" thickness); the inner surface 42B is copper plated.

Although the tank section shown in FIG. 4 appears very similar to the linacs depicted in FIGS. 2 and 3, the linac section of FIG. 4 contains several additional components. As with the linac of FIG. 3, each end of the tank wall 38B contains mounting means 41 such that individual tank sections 22B may be joined together. However, the end plates 24, 26 depicted in FIG. 2 would present additional complications if used in a long linac structure. End plates 24, 26 would not permit RF energy to travel between the adjacent tank sections shown in FIG. 5, necessitating a separate RF power feed port for each individual tank section. However, if sets of radial posts 46, 48 are used in lieu of end plates 24, 26 and situated at E-field minima, RF energy will flow into the adjacent tank sections. As shown in FIG. 4, these sets of radial posts 46, 48 are supported by the tank wall 38B.

The sets of radial posts 46, 48 each support a cup-shaped electrode 51, 53. Cup-shaped electrodes 51, 53, which contain a central aperture to allow for the passage of a charged particle beam, serve to support the washer supporting means. In the preferred embodiment, the washer supporting means consists of at least three hollow cylindrical metallic support rods 28B. The support rods 28B are hollow to allow for the passage of liquid coolant.

The optimum cavity radius for a plane wave transformer linac is equal to one-quarter the cavity length. However, in the case of the long linac structure, this constraint would yield impractical physical dimensions. For long linac structures, a cavity radius should be selected that is both convenient and greater than or equal to 1.4 times the wavelength lambda.

If a tank section 56 is to be used at either end of the long linac structure shown in FIG. 5, means must be provided to terminate the RF fields such that RF energy does not radiate from the ends of the accelerator into surrounding areas. Terminating cap 55, positioned at an E-field minimum, ensures that the electromagnetic fields remain substantially within the tank walls 38C of the accelerator. This terminating cap 55 is supported by the mounting means 41C of the tank wall 38C and also by the cup-shaped electrode 53, FIG. 4.

The two previously-described methods of coupling RF power into a short plane wave transformer linac, as depicted in FIGS. 9A and 9C, may also be used to couple power into a long linac structure. However, a third method of coupling power to a long linac, shown in FIG. 5, may prove advantageous in some applications. The RF power is carried from a high-powered microwave transmitter through a waveguide or a coaxial cable to a hybrid power splitter 88. The power splitter 88 may be a three-port device as shown in FIG. 5, or, alternatively, a four-port device. RF power is fed into the first port 82 and divided such that ports two and three 84, 86 receive approximately equal shares of the input power. If a four-port splitter were used, the fourth port would be terminated with a resistive load to dissipate any reflected RF power.

An RF power splitter 88 can be configured to mount between two adjacent tank sections 90, 92 as illustrated in FIG. 5. Port 84 of the power splitter 88 attaches to mounting means on the cup-shaped electrode 51C of tank section 90. In a similar fashion, port 86 of the power splitter 88 attaches to mounting means on the cup-shaped electrode 51D of tank section 92. Port 88 of the power splitter 82 is connected to a high-powered microwave transmitter through a section of waveguide or coaxial cable.

Regardless of which method is chosen to feed RF power into the long linac, the cup-shaped electrodes 51 perform a useful function. These electrodes 51 provide small, shielded regions surrounding the charged particle beam acceleration path where beam focusing magnets or beam diagnostic devices can be located. If desired, a magnetic quadrupole could be positioned here. However, a primary application of the long linac structure is to accelerate electrons. Generally, electron accelerators do not require much beam focusing, and for most applications a magneticquadrupole would not be necessary.

RF properties of long and short linacs are quite similar. As in the case of a short linac, the geometry of the long plane wave transformer linac provides for Transverse Electromagnetic Mode (TEM-Mode) operation in the outer cavity 32 between the tank wall 22 and the support rods 28. Thus, the TEM Mode is used to propagate power along the length of the structure, and to provide coupling between the individual cells 34. RF energy travels back and forth between the terminating caps 55 of the first and last linac sections 56, 58 (in FIG. 5) at the speed of light, setting up the standing wave pattern depicted in FIG. 6. The standing waves drive a TM02-like mode in the individual cells 34 (FIG. 1). These cells 34 are defined by the spaces between the washers 36.

Figure 7B:
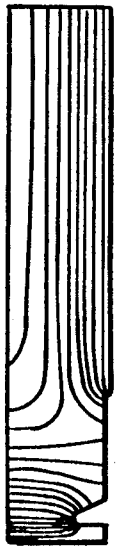
FIG. 7B illustrates the half-cell electric field distributions for the plane wave transformer linear accelerator structure.
Figure 7A:
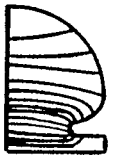
FIG. 7A illustrates the half-cell electric field distributions for the coupled-cavity linear accelerator structure of the prior art.

FIGS. 7A and 7B illustrate the electric field lines for the plane wave transformer linac (PWT) and the coupled-cavity linac (CCL). Note that the field lines for both types of linacs are substantially similar in the region close to the charged particle beam acceleration path. However, in the region close to the tank wall, the field lines of the PWT linac are virtually perpendicular to the wall, whereas the field lines of the CCL linac are almost tangential to the wall. Consequently, some of the real currents required to support the CCL field pattern are replaced by displacement currents in the PWT field pattern. The real currents of the CCL design are associated with ohmic heating and lower efficiencies, whereas the displacement currents of the PWT linac do not result in ohmic losses. Thus, FIGS. 7A and 7B demonstrate why a PWT linac will generally be much more efficient than its CCL counterpart.

Figure 8:
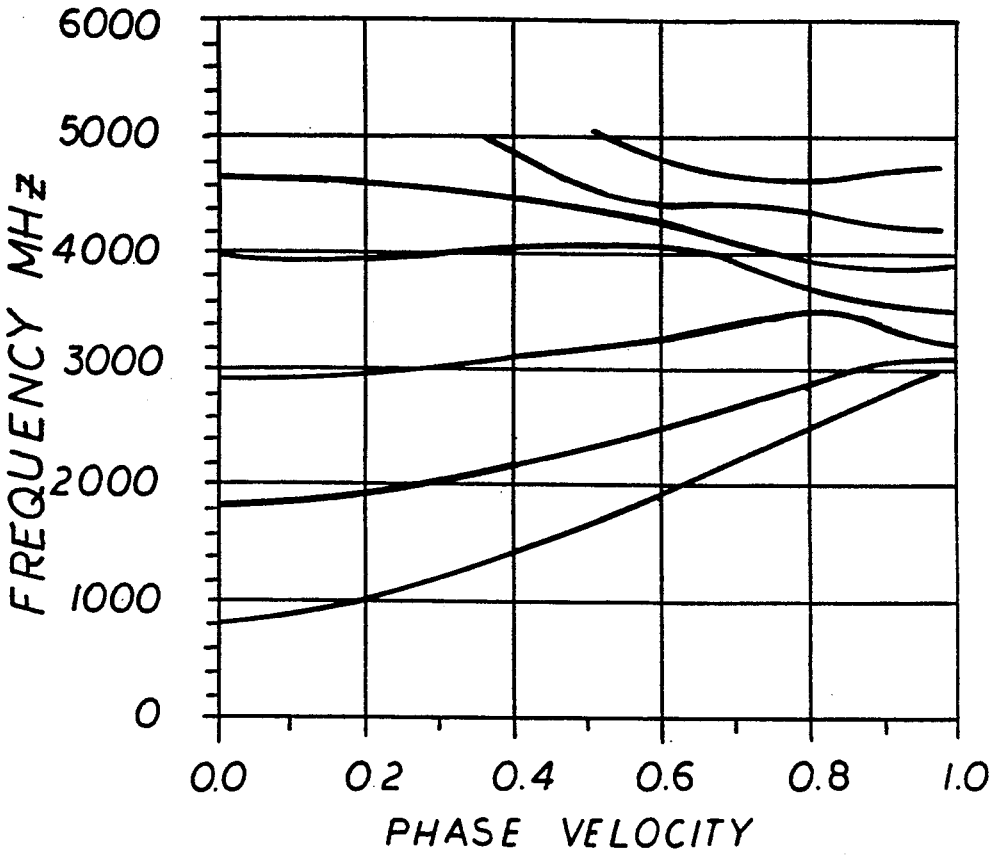
FIG. 8 illustrates the plane wave transformer linear accelerator dispersion curve showing frequency plotted against phase velocity for various passbands.

FIG. 8 shows a PWT dispersion curve which plots frequency versus phase velocity for various passbands. The curve shows that the lower passband of the linac is quite wide, implying a very strong coupling constant. In this case, the passband extends from approximately 810 MHz to over 3000 MHz, yielding a cell-to-cell coupling constant of 86%. By way of comparison, the coupling constant for a side-coupled linac is generally no greater than about 5%.

Figure 10A:
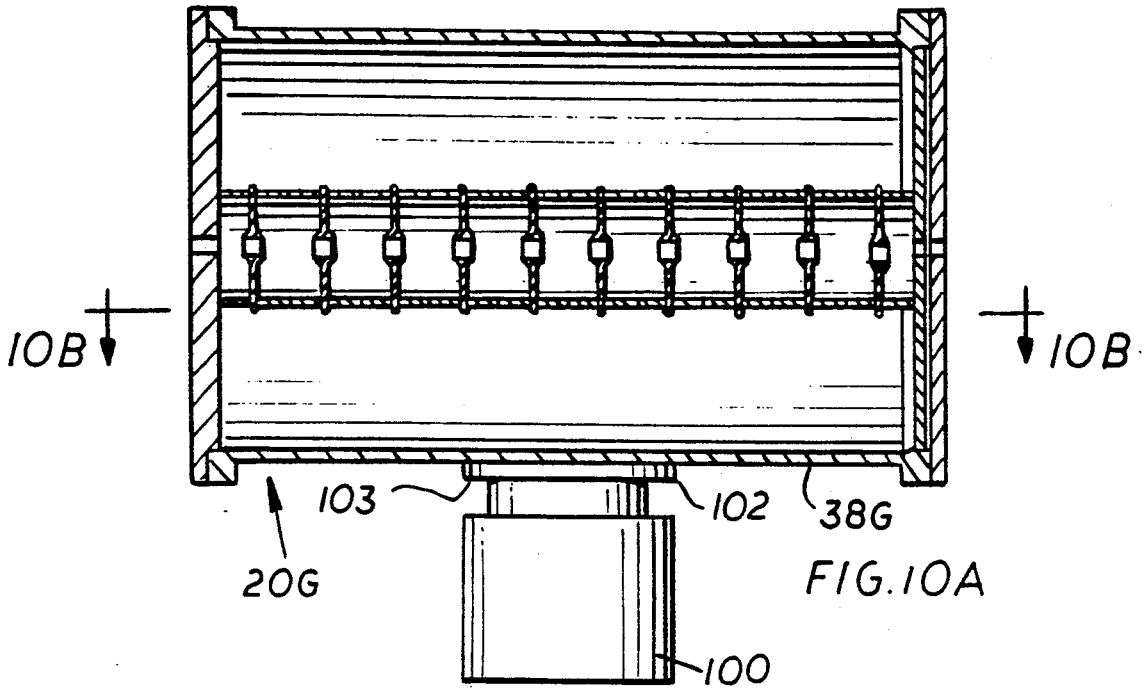
FIGS. 10A and 10B illustrate vacuum pump coupling to the plane wave transformer linear accelerator structure.
Figure 10B:
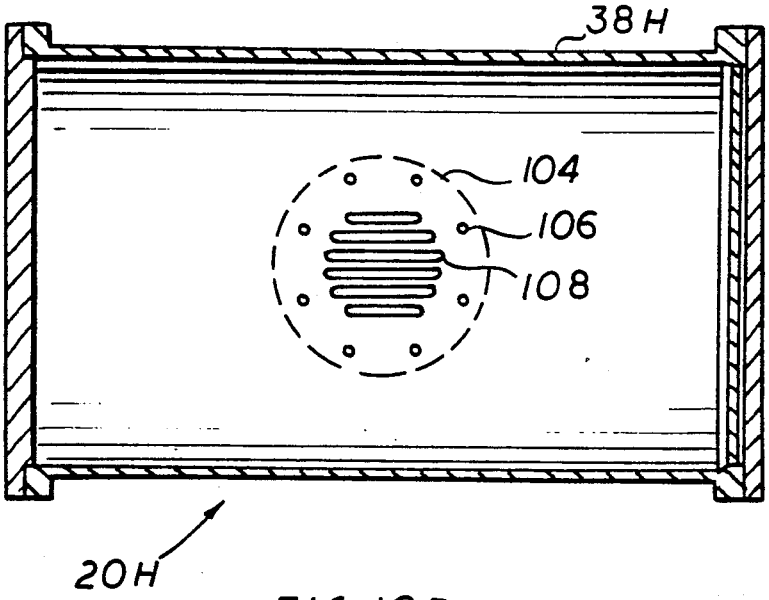

FIGS. 10A and 10B illustrate vacuum-pump coupling to the plane wave transformer linac 20G, 20H. The vacuum pump 100 attaches to the tank wall 38G, 38H of the PWT linac 20G, 20H. The tank wall 38G, 38H contains a plurality of slots 108; the long dimension of these slots 108 runs parallel to the charged particle beam acceleration path 49 (FIG. 2). The slots are surrounded by a flange 104 which contains a plurality of small holes 106. The vacuum pump 100 contains an identical flange 102 with holes 103. The holes 103 of the vacuum pump flange 102 line up with the holes 106 of the tank wall flange 104. The small holes 103, 106 accommodate screws, fasteners, or other mounting means.

The plane wave transformer linac structure of the present invention offers advantages over prior-art linac structures in the areas of power efficiency, field stability, weight, fabrication simplicity, and costs. A plane wave transformer linac will provide higher output energies and higher beam currents than a side-coupled linac when both linacs are fed with the same amount of input power. Furthermore, the plane wave transformer linac requires less input power than the side-coupled linac structure to achieve a fixed level of output energy or current. Relatively large temperature differentials may exist within the plane wave transformer linac, thereby simplifying the cooling system. The structure is relatively lightweight, simple to fabricate, simple to evacuate, easy to tune, and easy to excite.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed is:

1. A plane wave transformer linear accelerator structure for accelerating charged particles to velocities close to the speed of light, said accelerator including a tank section comprising:

a generally cylindrical tank wall having an inner surface, an outer surface, a first end and a second end;

a first end plate supported adjacent said first end of said tank wall, and a second end plate supported adjacent said second end of said tank wall, said end plates being substantially symmetrical about a central axis, said end plates each having a central aperture for accommodating the passage of a charged particle beam;

support means extending intermediate said first and said second end plates and partially defining at least one axially extending outer cavity and at least one axially extending inner cavity, said outer cavity being substantially disposed between said outer tank wall and said support means, said inner cavity being substantially disposed inside said outer cavity; and a plurality of discrete, axially-spaced washers held inside said tank wall, said washers supported by said support means, said washers each containing a central aperture, said apertures together defining a charged particle beam acceleration path through said tank section, said apertures situated substantially on said central axis of said tank section, said support means comprising a plurality of support rods.

2. A plane wave transformer linear accelerator as set forth in claim 1 further including means to introduce RF power into said linear accelerator, said means comprising an end plate containing a slot.

3. A plane wave transformer linear accelerator as set forth in claim 2 further comprising mounting means to attach a waveguide to said slot, said waveguide having a first end and a second end, said second end of said waveguide including a flange, said end plate including a substantially identical flange surrounding said slot.

4. A plane wave transformer linear accelerator as set forth in claim 1 further including means to introduce RF power into said linear accelerator, said means comprising a substantially cylindrical tank wall containing a slot.

5. A plane wave transformer linear accelerator as set forth in claim 4 further comprising mounting means to attach a waveguide to said slot, said waveguide having a first end and a second end, said second end of said waveguide including a flange, said tank wall including a substantially identical flange surrounding said slot.

6. A plane wave transformer linear accelerator as set forth in claim 1 further including means to remove air from said linear accelerator, said means to remove air comprising a tank wall containing at least one slot.

7. A plane wave transformer linear accelerator as set forth in claim 6 wherein said means to remove air from said linear accelerator further comprises mounting means to attach a vacuum pump to said slot such that said vacuum pump includes a flange and said tank wall includes a substantially identical flange surrounding said slot.

8. A plane wave transformer linear accelerator as set forth in claim 1 further comprising a source of RF power having a specific frequency f, said frequency f determining a specific operating wavelength lambda by the relationship f equals the speed of light divided by lambda, said linear accelerator dimensioned such that center-to-center spacing of said washers is approximately one-half lambda along said central axis of said tank section.

9. A plane wave transformer linear accelerator as set forth in claim 1 wherein radius of said outer cavity is approximately equal to the length of said outer cavity multiplied by 0.25.

10. A plane wave transformer linear accelerator structure for accelerating charged particles to velocities close to the speed of light, said accelerator including a tank section comprising:

a generally cylindrical tank wall having an inner surface, an outer surface, a first end and a second end;

a first end plate supported adjacent said first end of said tank wall, and a second end plate supported adjacent said second end of said tank wall, said end plates being substantially symmetrical about a central axis, said end plates each having a central aperture for accommodating the passage of a charged particle beam;

support means extending intermediate said first and said second end plates and partially defining at least one axially extending outer cavity and at least one axially extending inner cavity, said outer cavity being substantially disposed between said outer tank wall and said support means, said inner cavity being substantially disposed inside said outer cavity; and a plurality of axially-spaced washers disposed inside said tank wall, said washers supported by said support means, said washers each containing a central aperture, said apertures together defining a charged particle beam acceleration path through said tank section, said apertures situated substantially on said central axis of said tank section, said support means including at least three regularly spaced support rods, each of said support rods having a first end and a second end, each of said support rods positioned substantially parallel to central axis of said tank section.

11. A plane wave transformer linear accelerator as set forth in claim 10 wherein said support rods are hollow to allow for passage of a fluid coolant.

12. A plane wave transformer linear accelerator as set forth in claim 10 further including a structural end plate fixed to said second end of said support rods, said structural end plate including self-centering means comprising a resilient locking means, said structural end plate having a central aperture for accommodating said beam of charged particles.

13. A plane wave transformer linear accelerator as set forth in claim 12 wherein said second end of said tank wall contains self-centering means comprising a ramp projecting inwardly from said tank wall inner surface such that said ramp guides and exerts pressure upon said resilient locking means of said structural end plate when said structural end plate is properly positioned within said tank wall.

14. A method of assembling a plane wave transformer linear accelerator structure for accelerating charged particles to velocities greater than one-half the speed of light, said accelerator including a tank section comprising:

a generally cylindrical tank wall having an inner surface, an outer surface, a first end and a second end, wherein said second end of said tank wall contains self-centering means comprising a ramp projecting inwardly from said tank wall inner surface such that said ramp guides and exerts pressure upon said resilient locking means of said structural end plate when said structural end plate is properly positioned within said tank wall;

a first end plate supported adjacent said first end of said tank wall, and a second end plate supported adjacent said second end of said tank wall, said end plates being substantially symmetrical about a central axis, said end plates each having a central aperture for accommodating the passage of a charged particle beam;

support means extending intermediate said first and said second end plates and partially defining at least one axially extending outer cavity and at least one axially extending inner cavity, said outer cavity being substantially disposed between said outer tank wall and said support means, said inner cavity being substantially disposed inside said outer cavity; said support means including at least three regularly spaced support rods, each of said support rods having a first end and a second end, each of said support rods positioned substantially parallel to central axis of said tank section, said support rods being hollow to allow for passage of a fluid coolant;

a plurality of axially-spaced washers disposed inside said tank wall, said washers supported by said support means, said washers each containing a central aperture, said apertures together defining a charged particle beam acceleration path through said tank section, said apertures situated substantially on said central axis of said tank section; and a structural end plate fixed to said second end of said support rods, said structural end plate including self-centering means comprising a resilient locking means, said structural end plate having a central aperture for accommodating said beam of charged particles;

said method of assembling said plane wave transformer linear accelerator structure comprising the following steps:

(a) assembling said washers on said support rods and fixing said washers to said support rods to form a washer/support rod assembly having a first end and a second end;

(b) fixing said second end of said washer/support rod assembly to said structural end plate to form a washer/support rod/structural end plate assembly having a first end and a second end;

(c) assembling said second end plate on said second end of said tank wall and fixing said second end plate to said second end of said tank wall to form a tank wall/end plate assembly having a first end and a second end;

(d) assembling said first end of said washer/support rod/structural end plate assembly on said first end plate and fixing said first end of said washer/support rod/structural end plate assembly to said first end plate to form an end plate/support rod/washer/structural end plate assembly having a first end and a second end;

(e) inserting said second end of said end plate/washer/support rod/structural end plate assembly within said first end of said tank wall/end plate assembly;

(f) moving said end plate/washer/support rod/structural end plate assembly relative to said tank wall/end plate assembly such that said resilient locking means of said structural end plate contacts said self-centering ramp of said tank wall, fixing said end plate/washer/support rod/structural end plate assembly into position; and (g) fixing said first end of said end plate/washer/support rod/structural end plate assembly to said first end of said tank wall/end plate assembly.

15. A plane wave transformer linear accelerator structure for accelerating charged particles to velocities close to the speed of light, said accelerator including a tank section comprising:

a generally cylindrical tank wall having an inner surface, an outer surface, a first end and a second end;

a first end plate supported adjacent said first end of said tank wall, and a second end plate supported adjacent said second end of said tank wall, said end plates being substantially symmetrical about a central axis, said end plates each having a central aperture for accommodating the passage of a charged particle beam;

support means extending intermediate said first and said second end plates and partially defining at least one axially extending outer cavity and at least one axially extending inner cavity, said outer cavity being substantially disposed between said outer tank wall and said support means, said inner cavity being substantially disposed inside said outer cavity; and a plurality of axially-spaced washers disposed inside said tank wall, said washers supported by said support means, said washers each containing a central aperture, said apertures together defining a charged particle beam acceleration path through said tank section, said apertures situated substantially on said central axis of said tank section;

said accelerator structure further comprising a source of RF power having a specific frequency f, said frequency f determining a specific operating wavelength lambda according to the relationship f equals the speed of light divided by lambda, said linear accelerator dimensioned such that radius of said washers is substantially 0.41 times lambda.

16. A plane wave transformer linear accelerator structure for accelerating charged particles to velocities greater than one-half the speed of length, said accelerator including a tank section comprising:

a generally cylindrical tank wall including an inner surface, an outer surface, a first end and a second end;

two sets of radial posts, with one of said sets positioned adjacent said first end and the other of said sets positioned adjacent said second end;

a first cup-shaped electrode having a central aperture for passage of a charged particle beam, said first cup-shaped electrode supported by said one set of radial posts;

a second cup-shaped electrode having a central aperture for passage of said charged particle beam, said second cup-shaped electrode supported by said other set of radial posts;

support means extending intermediate said electrodes and defining at least one axially extending outer cavity and at least one axially extending inner cavity, said outer cavity being substantially disposed between said inner surface of said tank wall and said support means, said inner cavity being substantially disposed inside said outer cavity; and a plurality of axially-spaced washers disposed inside said tank wall, said washers being supported by said support means, said washers containing a central aperture, said apertures together defining a charged particle beam acceleration path through said tank section, said apertures situated substantially on said central axis of said tank section.

17. A plane wave transformer linear accelerator as set forth in claim 16 wherein said cup-shaped electrodes are situated at electric field minima within said tank wall.

18. A plane wave transformer linear accelerator as set forth in claim 16 further including a terminating cap which is substantially symmetrical about said central axis of said tank section, said terminating cap being supported adjacent said first end of said tank wall, said terminating cap providing means, to terminate said linear accelerator such that a TEM-mode operation is supported.

19. A plane wave transformer linear accelerator as set forth in claim 18 wherein said terminating cap is positioned at a current node such that electric field lines within said linear accelerator are not shorted.

20. A plane wave transformer linear accelerator as set forth in claim 16 wherein said support means includes at least three substantially regularly spaced support rods, each of said support rods having a first end and a second end and extending generally axially.

21. A plane wave transformer linear accelerator as set forth in claim 20 wherein said support rods are hollow to allow for passage of a fluid coolant.

22. A plane wave transformer linear accelerator as set forth in claim 16, further comprising a plurality of tank sections arranged in an end-to-end relationship.

23. A plane wave transformer linear accelerator as set forth in claim 22 wherein each of said tank sections includes mounting means for joining said tank sections, the mounting means of a first tank section engaging the mounting means of a second tank section such that said first tank section and said second tank section are held together so that the cup-shaped electrode at said second end of said first tank section and the cup-shaped electrode at said first end of said second tank section together define a cavity, the last-mentioned cavity containing means for focusing said beam of charged particles, said focusing means including a magnetic quadrupole.

24. A plane wave transformer linear accelerator as set forth in claim 22 further including means to introduce RF power into said linear accelerator, said means comprising a three-port power splitter.

* * * * *